US008979239B2

(12) United States Patent
Hamamoto

(10) Patent No.: US 8,979,239 B2
(45) Date of Patent: Mar. 17, 2015

(54) DRAWING DEVICE AND ERROR PROCESSING METHOD

(71) Applicant: Seiko Epson Corporation, Tokyo (JP)

(72) Inventor: Seiko Hamamoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/858,429

(22) Filed: Apr. 8, 2013

(65) Prior Publication Data

US 2013/0278669 A1 Oct. 24, 2013

(30) Foreign Application Priority Data

Apr. 24, 2012 (JP) ..... 2012-098467

(51) Int. Cl.

| | |
|---|---|
| ***B41J 25/308*** | (2006.01) |
| ***B41J 29/38*** | (2006.01) |
| ***B41J 29/393*** | (2006.01) |
| ***B41J 11/00*** | (2006.01) |
| ***B41J 15/16*** | (2006.01) |
| *B41J 25/00* | (2006.01) |

(52) U.S. Cl.

CPC ..... *B41J 29/393* (2013.01); *B41J 11/002* (2013.01); *B41J 15/165* (2013.01); *B41J 25/308* (2013.01); *B41J 2025/008* (2013.01)

USPC ..... 347/19; 347/16

(58) Field of Classification Search

USPC ..... 347/8, 16, 19

See application file for complete search history.

(56) References Cited

U.S. PATENT DOCUMENTS

| | | | | |
|---|---|---|---|---|
| 6,561,606 | B1 * | 5/2003 | Yoshida | 347/8 |
| 8,154,572 | B2 * | 4/2012 | Cummings et al. | 347/116 |
| 2007/0070099 | A1 * | 3/2007 | Beer et al. | 347/8 |
| 2011/0102504 | A1 * | 5/2011 | Wanibe | 347/37 |

FOREIGN PATENT DOCUMENTS

| | | | |
|---|---|---|---|
| JP | 2006-088454 | A | 4/2008 |
| JP | 2011-121255 | A | 6/2011 |

* cited by examiner

*Primary Examiner* — Jason Uhlenhake

(74) *Attorney, Agent, or Firm* — Global IP Counselors, LLP

(57) ABSTRACT

A drawing device includes a recording head that discharges ink which cures when receiving irradiation light; a transport device that transports a sheet coated with the ink discharged from the recording head, along a transport path that faces the recording head; a gap sensor that is provided further upstream along the transport path than the recording head, and detects an error with respect to a gap between the sheet and recording head; a light irradiation device which is provided further downstream along the transport path than the recording head, and irradiates the ink coated on the sheet with light; and an advancing/retracting device which retracts the recording head to a position away from the transport path.

8 Claims, 6 Drawing Sheets

DRAWING DEVICE AND ERROR PROCESSING METHOD

CROSS-REFERENCE TO RELATED APPLICATIONS

The entire disclosure of Japanese Patent Application No. 2012-098467, filed Apr. 24, 2012 is expressly incorporated by reference herein.

BACKGROUND

1. Technical Field

The present invention relates to a drawing device, an error processing method, and the like.

2. Related Art

An example of a drawing device is a recording device including a transport device which transports a recording medium, a recording head which discharges ultraviolet curing ink toward the recording medium, and an ultraviolet irradiation device which irradiates the ultraviolet curing ink coated on the recording medium with ultraviolet rays. In this type of recording device, when an error such as the recording medium becoming stuck (a jam) between the transport device and recording head or between the transport device and ultraviolet irradiation device has occurred, error resolution processing is permitted to be carried out after uncured ink remaining on the recording medium has been irradiated with ultraviolet rays, as described in JP-A-2006-88454 for example.

Error resolution processing is processing to eliminate the cause of an error and return to a normal state (resolving the error).

The following procedure is described in JP-A-2006-88454 as a processing method for when a jam has occurred.

First, jam processing is forbidden if a jam is detected. Next, transport of a recording medium is stopped. Next, a recording head is retracted. Next, an ultraviolet irradiation device is raised to avoid interference between the ultraviolet irradiation device and the jam in the recording medium. Next, the ultraviolet irradiation device is moved in the opposite direction to the transport direction of the recording medium, and the uncured ink on the recording medium are irradiated with ultraviolet rays. Next, jam processing is permitted.

As a result of the aforementioned procedure, it is possible to avoid uncured ink remaining on the recording medium from adhering to the inside of the recording device or the operator.

However, when the ultraviolet irradiation device is raised, the distance between the recording medium and the ultraviolet irradiation device increases. The intensity of the ultraviolet rays applied to the recording medium decreases as the distance from the ultraviolet irradiation device to the recording medium increases. Therefore, it is necessary to increase the intensity of the irradiated ultraviolet rays and to increase the irradiation time in order to ensure the irradiation energy required to cure the ink. This causes the sequence in the recording device to become complicated. As a result, it is likely that there will be a reduction in the efficiency in the processing of the recording device. In other words, there is a problem in that it has been difficult to attain efficiency in drawing devices.

Furthermore, in JP-A-2006-88454, when a jam in the recording medium occurs, the fact that a jam has occurred in the recording medium is detected by measuring torque that is outside of a specified value range for a transport drive motor. Therefore, in JP-A-2006-88454, because it is only possible to detect a jam after a jam has actually occurred, there is a risk that blemishes or ink smudging may occur in the recording head or ultraviolet irradiation device due to the recording medium having already become jammed at the time the jam is detected.

SUMMARY

An advantage of some aspects of the invention may be implemented in the following forms or application examples.

Application Example 1

Application Example 1 is a drawing device including: a discharge head that discharges a liquid which cures when receiving irradiation light: a transport device that transports a drawing medium coated with the liquid discharged from the discharge head, along a transport path that faces the discharge head; an error detection device that is provided further upstream along the transport path than the discharge head, and detects an error with respect to a gap between the drawing medium and the discharge head; an irradiation device that is provided further downstream along the transport path than the discharge head, and irradiates the liquid coated on the drawing medium with light; and a head movement device that retracts the discharge head to a position away from the transport path.

With the drawing device of this application example, it is possible to perform drawing on the drawing medium by using the irradiation device provided further downstream than the discharge head to irradiate the liquid coated on the drawing medium that is transported along the transport path with light. In this drawing device, because the error detection device is provided further upstream than the discharge head, it is possible to detect an error with respect to the gap between the drawing medium and the discharge head before the portion in the drawing medium where the error has been detected (hereafter referred to as the error portion) reaches the discharge head. As a result, the discharge head is retracted before the error portion interferes with the discharge head, and it is therefore possible to avoid the drawing medium from becoming stuck. Accordingly, the drawing medium remaining on the transport path from the discharge head to the irradiation device at the point in time when the error is detected is maintained in a normal state. Therefore, by transporting the drawing medium in a state in which the discharge head is retracted and the position of the irradiation device is maintained, it is possible to irradiate the liquid remaining on the transport path from the discharge head to the irradiation device with light. As a result, it is possible to irradiate, with light, the liquid that was coated on the drawing medium before the error was detected, and it is therefore possible to eject the drawing medium to outside the drawing device after the coated liquid has been cured. Furthermore, in this drawing device, it is possible to apply light while the position of the irradiation device is maintained even when an error has been detected, and the irradiation energy required to cure the liquid may be ensured without changing the light intensity or irradiation time. As a result, it is possible to easily avoid the sequence in the drawing device from becoming complicated, and it is therefore possible to easily attain efficiency in the processing of the drawing device.

Application Example 2

Application Example 2 is the aforementioned drawing device further including a support drum that is provided facing the discharge head with the transport path positioned therebetween, and rotates in accordance with the transport of the drawing medium while supporting the drawing medium.

In this application example, because the drawing medium can be supported by the support drum provided facing the discharge head, it is possible to easily stabilize and maintain the distance between the discharge head and drawing medium. As a result, it is possible to reduce irregularity in the coating location of the liquid with respect to the drawing medium, and it is therefore possible to easily improve quality in the drawing.

Application Example 3

Application Example 3 is the aforementioned drawing device further including a control unit that individually controls the drive for each of the transport device, the irradiation device, and the head movement device. When the error is detected, the control unit stops the drive for the transport device, drives the head movement device to retract the discharge head, and then restarts the drive for the transport device in a state in which the irradiation device is driven to apply the light.

In this application example, if an error is detected, the discharge head is retracted before the error portion interferes with the discharge head, and it is therefore possible to avoid the drawing medium from becoming stuck. By restarting the drive for the transport device in a state in which light is applied by the irradiation device, it is possible to irradiate the liquid remaining on the transport path from the discharge head to the irradiation device with light.

Application Example 4

Application Example 4 is the aforementioned drawing device further including a transport amount detection device that detects a transport amount of the drawing medium. When the drive for the transport device is restarted, the control unit controls the amount of drive for the transport device to be equal to or less than the transport amount corresponding to a length of the transport path from the error detection device to the irradiation device, on the basis of a detection result obtained by the transport amount detection device.

In this application example, when the drive for the transport device is restarted, the amount of drive for the transport device is controlled to be equal to or less than the transport amount corresponding to the length of the transport path from the error detection device to the irradiation device, and it is therefore possible to easily avoid the error portion reaching the irradiation device. Consequently, it is possible to easily avoid interference between the error portion and the irradiation device.

Application Example 5

Application Example 5 is the aforementioned drawing device further including a cap that covers a discharge opening for the liquid in the discharge head.

In this application example, it is possible to cover the discharge opening by the cap, and it is therefore possible to easily shield the discharge opening from light. As a result, it is possible to make it difficult for the liquid within the discharge opening to cure.

Application Example 6

Application Example 6 is an error processing method including: discharging a liquid which cures when receiving irradiation light from a discharge head onto a drawing medium which is transported along a transport path that faces the discharge head; irradiating the liquid coated on the drawing medium with light by an irradiation device provided further downstream along the transport path than the discharge head to perform drawing; stopping the transport of the drawing medium if an error with respect to a gap between the drawing medium and the discharge head is detected by an error detection device provided upstream of the discharge head; retracting the discharge head to a position away from the transport path; and restarting the transport of the drawing medium in a state in which the light is applied by the irradiation device.

In the error processing method of this application example, transport of the drawing medium is stopped if an error is detected by the error detection device provided further upstream than the discharge head when drawing is performed on the drawing medium by the irradiation device irradiating the liquid coated on the transported drawing medium with light. It is consequently possible to stop the transport operation before the portion in the drawing medium where the error has been detected (hereafter referred to as the error portion) interferes with the discharge head, and it is therefore possible to avoid the drawing medium from becoming stuck. Accordingly, the drawing medium remaining on the transport path from the discharge head to the irradiation device at the point in time when the error is detected is maintained in a normal state. The discharge head is retracted, and then transport of the drawing medium is restarted in a state in which light is applied by the irradiation device. During this process, the drawing medium remaining on the transport path from the discharge head to the irradiation device is maintained in a normal state, and it is therefore possible to restart the transport of the drawing medium in a state in which the position of the irradiation device is maintained. It is therefore possible to irradiate the liquid remaining on the transport path from the discharge head to the irradiation device with light. As a result, it is possible to irradiate, with light, the liquid that was coated on the drawing medium before the error was detected, and it is therefore possible to eject the drawing medium to outside the drawing device after the coated liquid has been cured. Furthermore, in this error processing method, it is possible to apply light with the position of the irradiation device being maintained even when an error has been detected, and the irradiation energy required to cure the liquid may be ensured without changing the light intensity or irradiation time. As a result, it is possible to easily avoid the sequence in the error processing from becoming complicated, and it is therefore possible to easily attain efficiency in the drawing process.

Application Example 7

Application Example 7 is the aforementioned error processing method further including, stopping transport of the drawing medium after the transport of the drawing medium has been restarted, before the portion in the drawing medium where the error has been detected reaches the irradiation device.

In this application example, because the transport of the drawing medium is stopped before the error portion reaches the irradiation device, it is possible to easily avoid interference between the error portion and the irradiation device.

BRIEF DESCRIPTION OF THE DRAWINGS

The invention will be described with reference to the accompanying drawings, wherein like numbers reference like elements.

DESCRIPTION OF EXEMPLARY EMBODIMENTS

A printer that is one example of an drawing device according to an embodiment will be described with reference to the drawings. It should be noted that, in the figures, the scale of structures and components in a certain figure may be different from the scale in other figures in order to enlarge the structures illustrated in the figures to a perceivable size.

Figure 1:
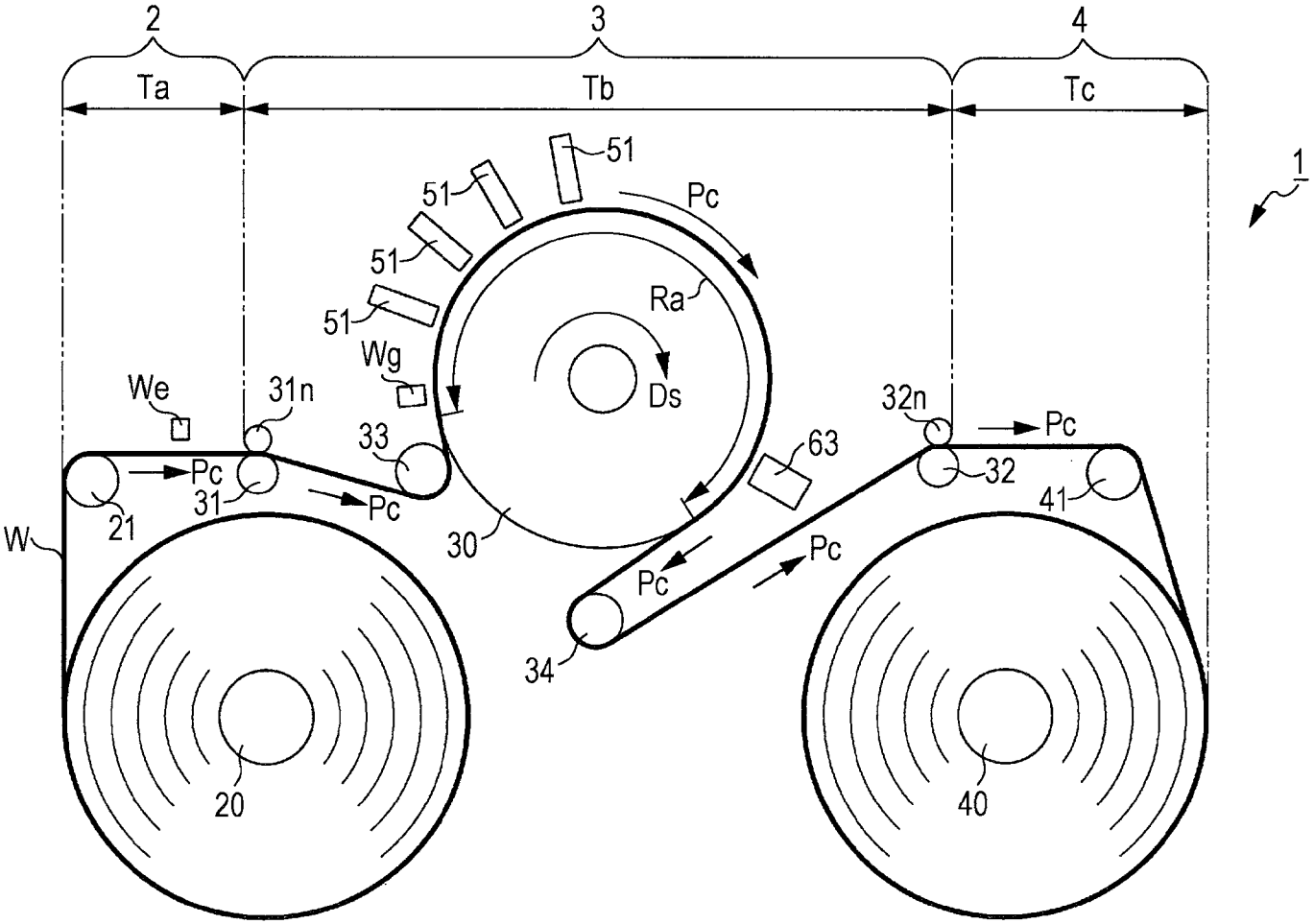
FIG. 1 is a diagram illustrating a schematic configuration of a printer according to the present embodiment.

FIG. 1 is a front view illustrating a schematic configuration of a printer according to the embodiment. As illustrated in FIG. 1, in a printer 1, one sheet W (web) is stretched between a feed-out shaft 20 and wind-in shaft 40 with both ends of the sheet W being wound in the form of rolls around the feed-out shaft 20 and the wind-in shaft 40. The sheet W is transported from the feed-out shaft 20 to the wind-in shaft 40 along a transport path Pc along which the sheet W is stretched in this manner. In the printer 1, an image is then recorded on the sheet W that is transported along this transport path Pc. The types of the sheet W are broadly divided into paper and film types. Specific examples of the paper type of sheet include high-quality paper, cast paper, art paper, and coated paper, etc., and specific examples of the film type of sheet include synthetic paper, polyethylene terephthalate (PET), and polypropylene (PP). Basically, the printer 1 includes: a feed-out section 2 which feeds out the sheet W from the feed-out shaft 20; a processing section 3 which records an image onto the sheet W fed out from the feed-out section 2; and a wind-in section 4 which winds the sheet W, on which the image has been recorded by the processing section 3, onto the wind-in shaft 40. It should be noted that in the following description, from among both surfaces of the sheet W, the surface on which the image is recorded is referred to as the front surface, and the surface on the opposite side thereof is referred to as the rear surface.

The feed-out section 2 includes: the feed-out shaft 20 which has an end of the sheet W wound therearound; and a driven roller 21 around which the sheet W drawn out from the feed-out shaft 20 is wound. The feed-out shaft 20 supports an end of the sheet W with this end being wound therearound, in a state in which the front surface of the sheet W is facing outward. The feed-out shaft 20 then rotates in the clockwise direction of FIG. 1, and the sheet W wound around the feed-out shaft 20 is therefore fed out to the processing section 3 via the driven roller 21. In addition, the sheet W is wound around the feed-out shaft 20 using a core tube (not shown in the figures) that can be attached to and detached from the feed-out shaft 20. Therefore, when the sheet W on the feed-out shaft 20 is used up, the sheet W on the feed-out shaft 20 can be replaced by attaching, to the feed-out shaft 20, a new core tube having a roll-shaped sheet W wound therearound.

In the processing section 3, an image is recorded on the sheet W by processing being appropriately carried out by a plurality of recording heads 51 and a light irradiation device 63, etc., which are described hereafter, arranged along the outer peripheral surface of a platen drum 30, while the sheet W fed out from the feed-out section 2 is supported by the platen drum 30. A front driving roller 31 and rear driving roller 32 are provided on both sides of the platen drum 30 in this processing section 3, and the sheet W which is transported from the front driving roller 31 to the rear driving roller 32 is supported by the platen drum 30 and is subjected to image recording.

The front driving roller 31 has, on the outer peripheral surface thereof, a plurality of very small protrusions formed by thermal spraying, and the sheet W fed out from the feed-out section 2 is wound therearound from the rear surface side. The front driving roller 31 then rotates in the clockwise direction of FIG. 1, and the sheet W fed out from the feed-out section 2 is therefore transported downstream along the transport path Pc. It should be noted that a nip roller 31*n* is provided for the front driving roller 31. This nip roller 31*n* contacts with the front surface of the sheet W while being urged toward the front driving roller 31, and the sheet W is inserted between the nip roller 31*n* and the front driving roller 31. As a result of this, frictional force between the front driving roller 31 and the sheet W is ensured, and the transport of the sheet W implemented by the front driving roller 31 can be reliably carried out.

The platen drum 30 is a cylindrical drum rotatably supported by a support mechanism which is not shown in the figures, and the sheet W transported from the front driving roller 31 to the rear driving roller 32 is wound around the platen drum 30 from the rear surface side. This platen drum 30 supports the sheet W from the rear surface side while receiving the frictional force with the sheet W and rotating in a driven manner in the transport direction Ds of the sheet W. In addition, driven rollers 33 and 34 which fold the sheet W back on itself are provided at both sides of the platen drum 30 around the portion where the sheet W is wound. The driven roller 33 from among these driven rollers has the front surface of the sheet W wound therearound, between the front driving roller 31 and platen drum 30, and folds the sheet W back on itself. The driven roller 34, however, has the front surface of the sheet W wound therearound, between the platen drum 30 and rear driving roller 32, and folds the sheet W back on itself. As described above, because the sheet W is folded back on itself at both the upstream and downstream sides of the platen drum 30 in the transport direction Ds, it is possible to ensure that the portion of the platen drum 30 around which the sheet W is wound is long.

The rear driving roller 32 has, on the outer peripheral surface thereof, a plurality of very small protrusions formed by thermal spraying, and the sheet W that has been transported from the platen drum 30 via the driven roller 34 is wound therearound from the rear surface side. The rear driving roller 32 rotates in the clockwise direction of FIG. 1, and the sheet W is thereby transported to the wind-in section 4. It should be noted that a nip roller 32*n* is provided for the rear driving roller 32. This nip roller 32*n* contacts with the front surface of the sheet W while being urged toward the rear driving roller 32, and the sheet W is inserted between the nip roller 32*n* and the rear driving roller 32. As a result of this, frictional force between the rear driving roller 32 and sheet W is ensured, and the transport of the sheet W implemented by the rear driving roller 32 can be reliably carried out.

As described above, the sheet W that is transported from the front driving roller 31 to the rear driving roller 32 is supported on the outer peripheral surface of the platen drum 30. The plurality of recording heads 51, which correspond to mutually different colors, are provided in the processing section 3 in order to record a color image onto the front surface of the sheet W that is supported on the platen drum 30. To be more specific, four recording heads 51 which correspond to yellow, cyan, magenta, and black are arranged side-by-side in the transport direction Ds in this color order. The recording heads 51 have discharge outlets which discharge ink in the form of droplets. The recording heads 51 face the front surface of the sheet W wound around the platen drum 30, with a predetermined gap (clearance) provided therebetween, and discharge ink of a corresponding color from the discharge outlets by an ink jet system. The recording heads 51 discharge ink onto the sheet W that is transported in the transport direction Ds to thereby coat the front surface of the sheet W. The ink coated on the front surface of the sheet W forms a color image.

In this case, ultraviolet (UV) ink (photocuring ink) which cures by being irradiated with ultraviolet rays (light) is used as the ink. In the embodiment, the light irradiation device 63 is provided in the processing section 3. The light irradiation device 63 includes a UV lamp (not shown in the figures) which emits light in order to cure and adhere the ink to the sheet W. It should be noted that this ink curing can also be implemented by separation into the two stages of temporary curing and full curing. In this case, a UV lamp for temporary curing is arranged between each of the plurality of recording heads 51. In other words, the UV lamps arranged between the recording heads 51 apply weak ultraviolet rays to thereby cure the ink to an extent such that the shape of the ink is maintained (temporary curing), and do not fully cure the ink. The light irradiation device 63 for full curing is provided downstream in the transport direction Ds from the plurality of recording heads 51. In other words, the light irradiation device 63 irradiates ultraviolet rays that are stronger than those irradiated by the UV lamps arranged between the recording heads 51, to thereby fully cure the ink (full curing). By carrying out temporary curing and full curing in this manner, it is possible to fix a color image formed by the plurality of recording heads 51 to the front surface of the sheet W.

As described above, in the processing section 3, the sheet W is wound around and supported on the outer peripheral surface of the platen drum 30. The function units, namely the recording heads 51 and light irradiation device 63, face a winding region Ra of the platen drum 30 around which the sheet W is wound, with the sheet W positioned therebetween, and appropriately discharge and cure the ink on the front surface of the sheet W wound around the winding region Ra. A color image is thereby formed on the sheet W. The sheet W on which this color image is formed is transported to the wind-in section 4 by the rear driving roller 32.

The wind-in section 4 includes the wind-in shaft 40 around which an end of the sheet W is wound, and further includes a driven roller 41 around which the sheet W is wound from the rear surface, between the wind-in shaft 40 and the rear driving roller 32. The wind-in shaft 40 winds in and supports the end of the sheet W, in a state in which the front surface of the sheet W is facing outward. That is, when the wind-in shaft 40 rotates in the clockwise direction of FIG. 1, the sheet W that has been transported from the rear driving roller 32 is wound onto the wind-in shaft 40 via the driven roller 41. More specifically, the sheet W is wound onto the wind-in shaft 40 using a core tube (not shown in the figures) that can be attached to and detached from the wind-in shaft 40. It is therefore possible to remove the sheet W together with the core tube when the entirety of the sheet W has been wound onto the wind-in shaft 40.

Figure 2A:
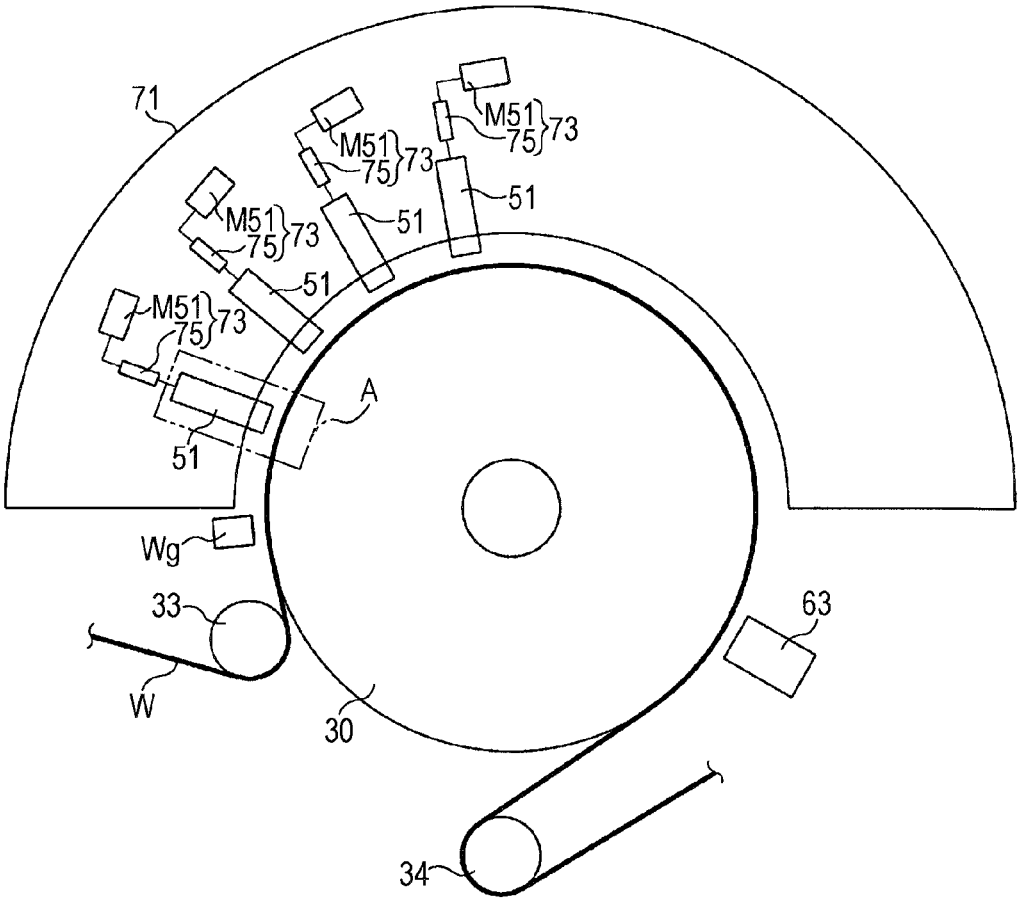
FIGS. 2A and 2B are diagrams illustrating the configuration of a processing section of the printer according to the embodiment.

In the embodiment, the recording heads 51 are supported by a support frame 71 as illustrated in FIG. 2A, which is an enlarged view of the processing section 3. Furthermore, an advancing/retracting device 73 is provided for each of the recording heads 51. The advancing/retracting devices 73 are able to advance and retract the recording heads 51 in a direction normal to the outer peripheral surface of the platen drum 30.

Figure 2B:
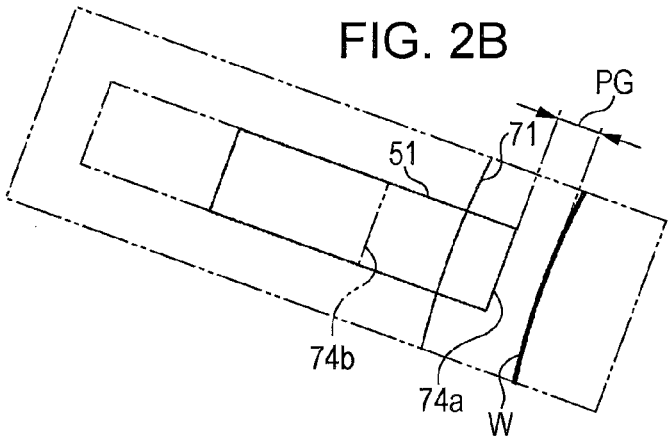

The recording heads 51 are able to advance and retract between an advanced position 74*a* and a retracted position 74*b* by the advancing/retracting device 73 as illustrated in FIG. 2B, which is an enlarged view of section A in FIG. 2A. The advanced position 74*a* is a position where a recording head 51 faces the sheet W with a predetermined gap PG therebetween. The retracted position 74*b* is a position further away from the platen drum 30 than the advanced position 74*a*.

The advancing/retracting devices 73 include: an advancing/retracting motor M51 which generates motive power for causing the recording heads 51 to retract and advance; and an advancing/retracting mechanism 75. The motive power from the advancing/retracting motors M51 is transmitted to the recording heads 51 using the advancing/retracting mechanisms 75. A variety of mechanisms may be used as the advancing/retracting mechanisms 75, such as a linear guide mechanism, slide mechanism, screw mechanism, and so on. In the embodiment, an example is given in which one advancing/retracting device 73 is provided for each recording head 51; however, it is also possible for one advancing/retracting device 73 to be provided for the plurality of recording heads 51, and for the plurality of recording heads 51 to be advanced and retracted in a direction normal to the outer peripheral surface of the platen drum 30, by the one advancing/retracting device 73.

Figure 3:
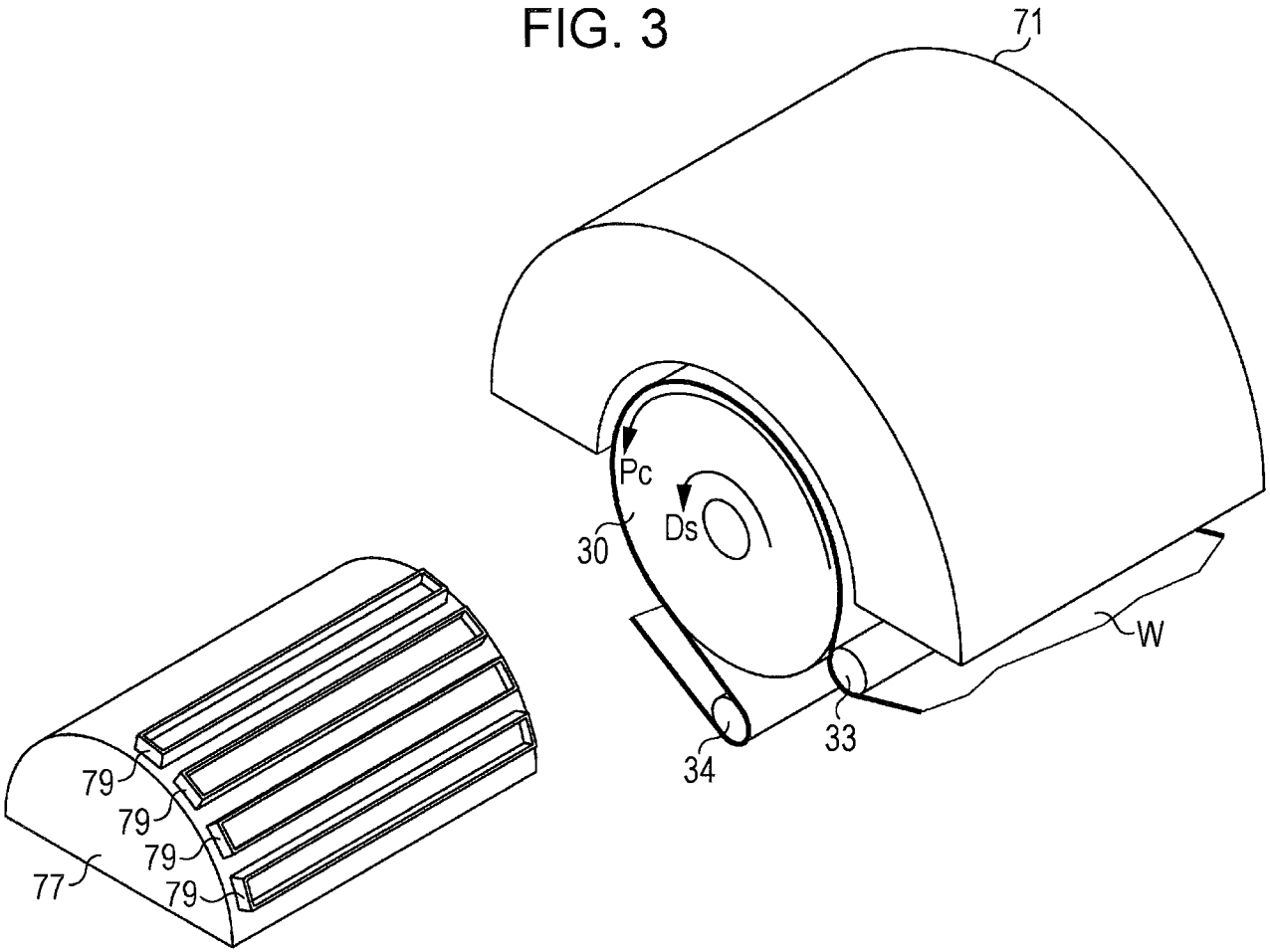
FIG. 3 is a perspective view illustrating the configuration of a maintenance unit in the embodiment.

Furthermore, in the embodiment, the printer 1 is provided with a maintenance unit at the rear side of the platen drum 30 when viewed in FIG. 2A. As illustrated in FIG. 3, the maintenance unit 77 and platen drum 30 are both lined up in a direction orthogonal to the transport path Pc. The maintenance unit 77 includes a plurality of caps 79. It should be noted that the number of caps 79 corresponds to the number of recording heads 51. Therefore, four caps 79 are provided in the embodiment.

Figure 4:
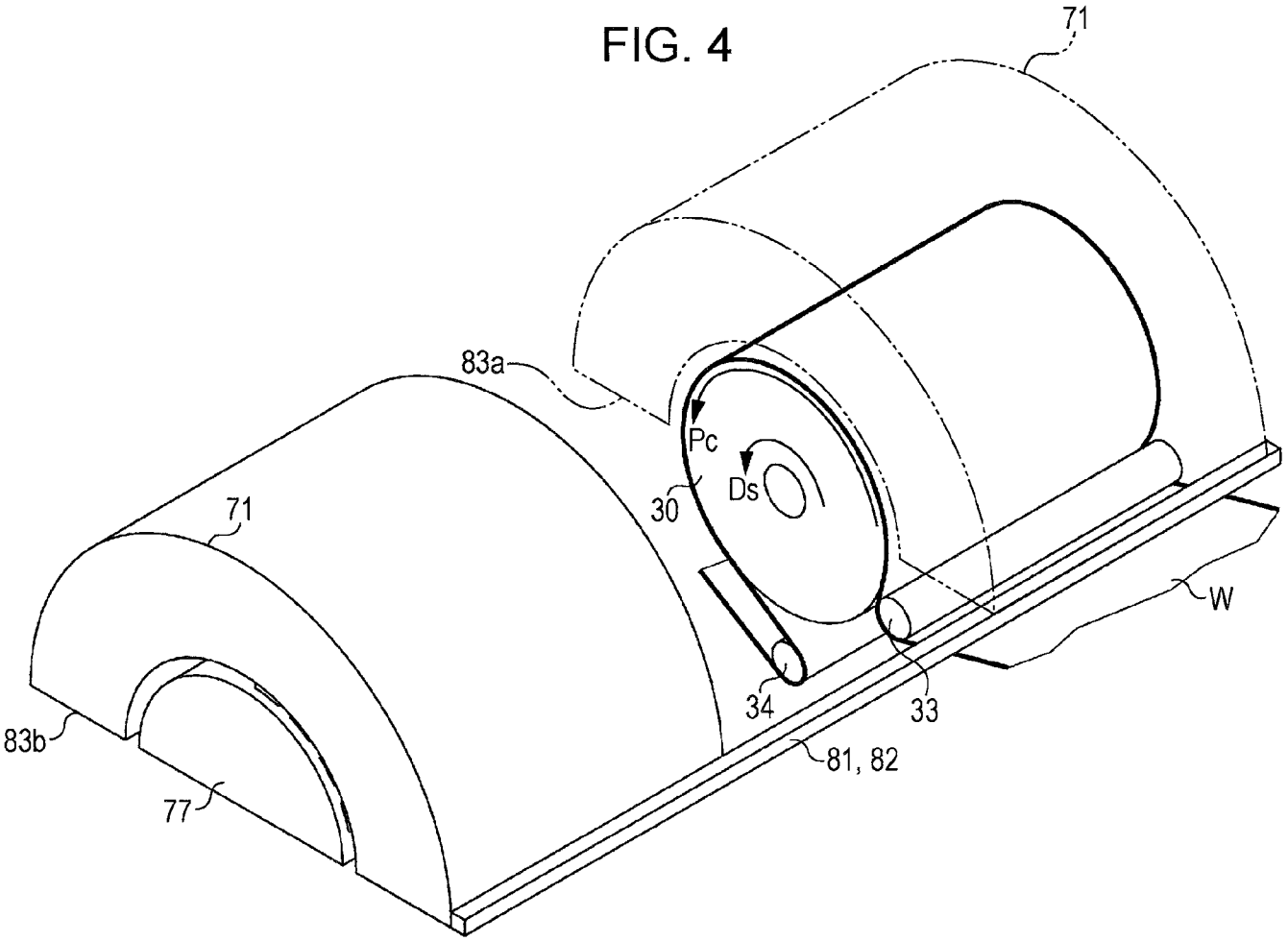
FIG. 4 is a perspective view illustrating a maintenance location in the embodiment.

Furthermore, as illustrated in FIG. 4, an advancing/retracting device 81 which advances and retracts the support frame 71 is provided in the printer 1. The advancing/retracting device 81 is able to advance and retract the support frame 71 in the direction of the rotary shaft of the platen drum 30.

The support frame 71 is able to advance and retract between a processing position 83*a* and a maintenance position 83*b*, by the advancing/retracting device 81. The processing position 83*a* is a position where the support frame 71 faces the platen drum 30. The maintenance position 83*b* is a position where the support frame 71 faces the maintenance unit 77.

The advancing/retracting device 81 includes an advancing/retracting motor M81 which is described hereafter, and an advancing/retracting mechanism 82. The advancing/retracting motor M81 generates motive power in order to advance and retract the support frame 71. The motive power from the advancing/retracting motor M81 is transmitted to the support frame 71 using the advancing/retracting mechanism 82. A variety of mechanisms may be used as the advancing/retracting mechanism 82, such as a linear guide mechanism, slide mechanism, screw mechanism, and so on.

When the support frame 71 is located in the maintenance position 83*b*, the recording heads 51 face the corresponding caps 79. The recording heads 51 are advanced to the advanced position 74*a* in a state in which the recording heads 51 are facing the caps 79, and it is thereby possible for the recording heads 51 to be covered by the caps 79. As a result of the recording heads 51 being covered by the caps 79, it is possible to protect the recording heads 51. As a result of the recording heads 51 being covered by the caps 79, it is possible to increase the airtight properties of the discharge outlets of the recording heads 51. Therefore, as a result of the recording heads 51 being covered by the caps 79, it is possible to limit the drying of the ink within the recording heads 51 to a low degree. Furthermore, in the embodiment, the caps 79 have high light-shielding properties. Consequently, as a result of the recording heads 51 being covered by the caps 79, it is possible to shield the ink within the discharge outlets from ultraviolet rays. Therefore, as a result of the recording heads 51 being covered by the caps 79, it is possible to limit the curing of the ink within the discharge outlets to a low degree.

Figure 5:
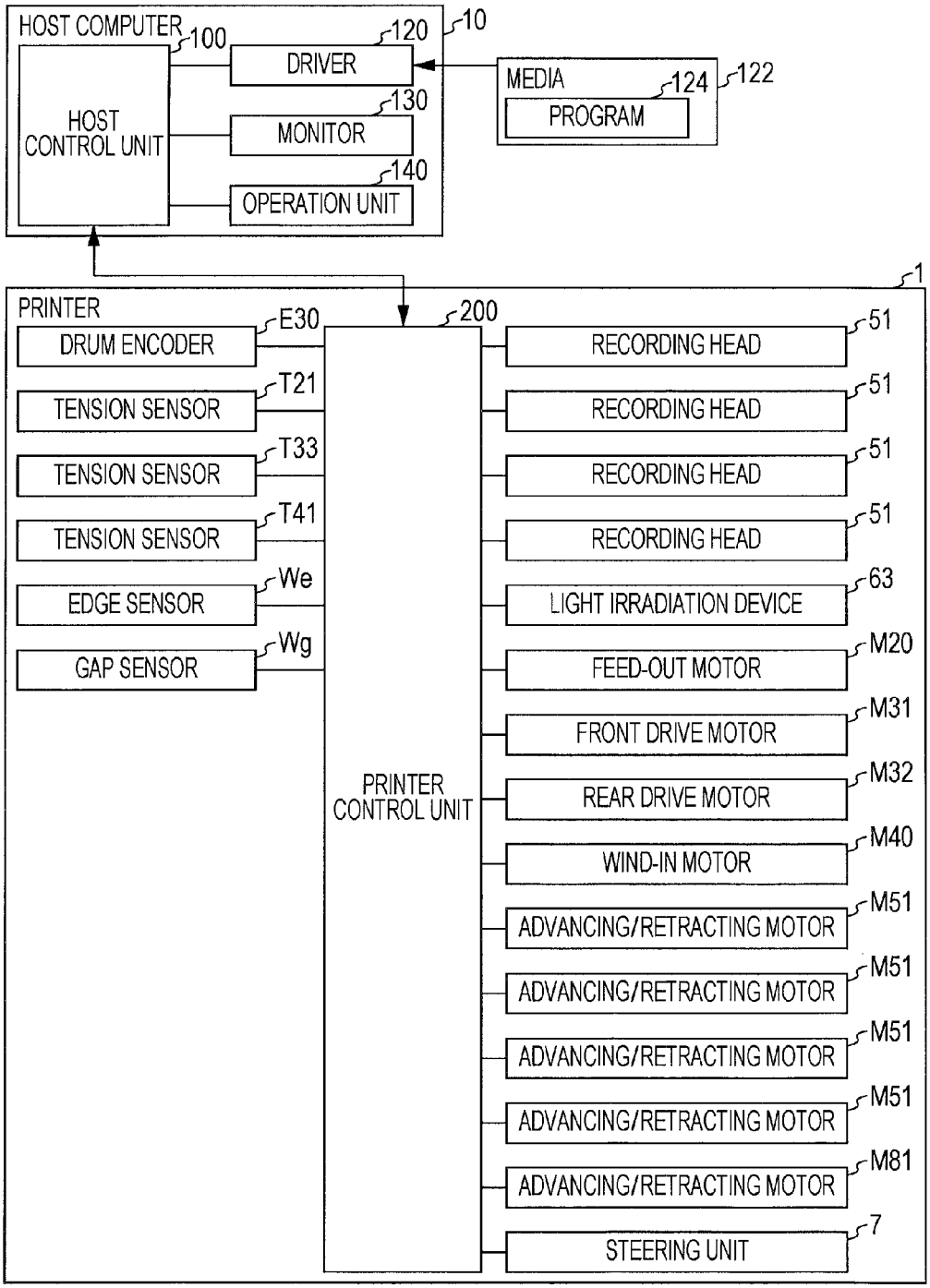
FIG. 5 is a block diagram illustrating a schematic configuration of the printer according to the embodiment.

The aforementioned description is a summary of the device configuration for the printer 1. Next, an electrical configuration which controls the printer 1 will be described. FIG. 5 is a block diagram schematically illustrating an electrical configuration which controls the printer illustrated in FIG. 1. The operation of the aforementioned printer 1 is controlled by a host computer 10 which is illustrated in FIG. 5. In the host computer 10, a host control unit 100 which presides over control operations is made up of a central processing unit (CPU) and memory. Furthermore, a driver 120 is provided in the host computer 10, and this driver 120 reads out a program 124 from media 122. It should be noted that it is possible to use a variety of media as the media 122, such as a compact disk (CD), digital versatile disk (DVD), Universal Serial Bus (USB), and the like. The host control unit 100 controls each section of the host computer 10 and controls the operation of the printer 1 on the basis of the program 124 that is read out from the media 122.

Furthermore, a monitor 130 including a liquid crystal display, etc., and an operation unit 140 including a keyboard and mouse, etc. are provided for the host computer 10 as interfaces for an operator. An image to be printed and also a menu screen are displayed on the monitor 130. The operator therefore operates the operation unit 140 while checking the monitor 130, and it is consequently possible to open a printing setting screen from the menu screen and set a variety of printing conditions such as the type of printing medium, the size of printing medium, and printing quality. It should be noted that a variety of variations are possible with respect to the specific configuration of the interfaces for the operator, and, for example, a touch panel display may be used as the monitor 130, and the operation unit 140 may be constituted by the touch panel of this monitor 130.

Furthermore, the printer 1 is provided with a printer control unit 200 which controls each section of the printer 1 in accordance with an instruction from the host computer 10. The recording heads 51, light irradiation device 63, and each device section in the sheet transport system are controlled by the printer control unit 200. The details of the control performed by the printer control unit 200 with respect to these device sections are as follows.

The printer control unit 200 controls the ink discharge timing of the recording heads 51 which form a color image, in accordance with the transport of the sheet W. To be specific, the control of this ink discharge timing is carried out on the basis of the output (detection value) of a drum encoder E30 which is attached to the rotary shaft of the platen drum 30 and detects the rotational position of the platen drum 30. To be more specific, because the platen drum 30 rotates in a driven manner in accordance with the transport of the sheet W, if reference is made to the output of the drum encoder E30 which detects the rotational position of the platen drum 30, it is possible to obtain the transport position and transport amount of the sheet W. The printer control unit 200 generates a print timing signal (PTS) from the output of the drum encoder E30 and controls the ink discharge timing of the recording heads 51 on the basis of this PTS, and the ink discharged by the recording heads 51 thereby hits a target position on the transported sheet W and forms a color image. Furthermore, the drive of the light irradiation device 63 is also controlled by the printer control unit 200.

In addition, the printer control unit 200 has the function of controlling the transport of the sheet W, and this is explained in detail using FIG. 1. To be specific, from among the members making up the sheet transport system, a motor is connected to each of the feed-out shaft 20, front driving roller 31, rear driving roller 32, and wind-in shaft 40. The printer control unit 200 controls the speed and torque of the motors while rotating the motors, and controls the transport of the sheet W. The details regarding this transport control for the sheet W are as follows.

The printer control unit 200 rotates a feed-out motor M20 which drives the feed-out shaft 20, and supplies the sheet W from the feed-out shaft 20 to the front driving roller 31. In this process, the printer control unit 200 controls the torque of the feed-out motor M20 and adjusts the tension (feed-out tension Ta) of the sheet W from the feed-out shaft 20 to the front driving roller 31. That is, a tension sensor T21 which detects the feed-out tension Ta is attached to the driven roller 21 positioned between the feed-out shaft 20 and front driving roller 31. This tension sensor T21 can be constituted by, for example, a load cell which detects the force received from the sheet W. The printer control unit 200 carries out feedback control with respect to the torque of the feed-out motor M20 on the basis of a detection result of the tension sensor T21, and adjusts the feed-out tension Ta of the sheet W.

During this process, the printer control unit 200 feeds out the sheet W while adjusting the position in the width-direction (direction orthogonal to the paper surface in FIG. 1) of the sheet W supplied from the feed-out shaft 20 to the front driving roller 31. To be more specific, a steering unit 7 which displaces each of the feed-out shaft 20 and driven roller 21 in the shaft direction (in other words, the width direction of the sheet W) is provided in the printer 1. Furthermore, an edge sensor We which detects an edge of the sheet W in the width direction thereof is positioned between the driven roller 21 and front driving roller 31. This edge sensor We can be constituted by, for example, a distance sensor such as an ultrasonic sensor. The printer control unit 200 carries out feedback control with respect to the steering unit 7 on the basis of a detection result of the edge sensor We, and adjusts the position of the sheet W in the width direction. The sheet W is thereby arranged in a suitable position in the width direction and transport deficiencies of the sheet W such as meandering are suppressed.

Furthermore, the printer control unit 200 rotates a front drive motor M31 which drives the front driving roller 31, and rotates a rear drive motor M32 which drives the rear driving roller 32. As a result of this, the sheet W fed out from the feed-out section 2 passes through the processing section 3. During this process, speed control is carried out with respect to the front drive motor M31, whereas torque control is carried out with respect to the rear drive motor M32. That is, the printer control unit 200 adjusts the rotation speed of the front drive motor M31 to be constant, on the basis of the encoder output of the front drive motor M31. The sheet W is thereby transported at a constant speed by the front driving roller 31.

Furthermore, the printer control unit 200 controls the torque of the rear drive motor M32 and adjusts the tension (process tension Tb) of the sheet W from the front driving roller 31 to the rear driving roller 32. To be more specific, a tension sensor T33 which detects the process tension Tb is attached to the driven roller 33 positioned between the front driving roller 31 and platen drum 30 on the transport path Pc. This tension sensor T33 can be constituted by, for example, a load cell which detects the force received from the sheet W. As described above, the tension of the sheet W from the front driving roller 31 toward the platen drum 30 is detected by the tension sensor T33. The printer control unit 200 carries out feedback control with respect to the torque of the rear drive motor M32 on the basis of a detection result of the tension sensor T33, and adjusts the process tension Tb of the sheet W.

As described above, the tension of the sheet W is detected at the location of the driven roller 33 positioned on the transport path Pc between the front driving roller 31 and rear driving roller 32. The torque of the rear driving roller 32 is controlled on the basis of this detection result. It is therefore possible to impart stable process tension Tb to the sheet W from the driven roller 33 to the rear driving roller 32. An image is then recorded on the surface of the sheet W supported by the platen drum 30 positioned on the transport path Pc between the driven roller 33 and rear driving roller 32. It is therefore possible to record an image on the sheet W which has stable tension.

In addition, as illustrated in FIG. 1, a gap sensor Wg is provided in the printer 1, further upstream on the transport path Pc than the recording heads 51. In the embodiment, the gap sensor Wg is provided on the transport path Pc, between the driven roller 33 and the recording heads 51. The gap sensor Wg faces the platen drum 30 with the transport path Pc positioned therebetween. The gap sensor Wg detects displacement in the surface of the sheet W with respect to the gap sensor Wg. The gap PG between the sheet W and recording heads 51 can be obtained on the basis of a detection result from the gap sensor Wg. A laser displacement meter, for example, may be employed as the gap sensor Wg.

The detection result from the gap sensor Wg is output to the printer control unit 200, as illustrated in FIG. 5. The printer control unit 200 monitors whether or not the gap PG (see FIG. 2B) between the sheet W and recording heads 51 is within a permitted range, on the basis of the detection result from the gap sensor Wg. It should be noted that the case in which a foreign substance has adhered to the sheet W and the case in which a crease has developed in the sheet W are examples of when the gap PG has a value below the lower limit value of the permitted range.

The sheet W on which an image has been recorded by the processing section 3 (see FIG. 1) is wound onto the wind-in shaft 40 in the wind-in section 4. During this process, the printer control unit 200 illustrated in FIG. 5 rotates a wind-in motor M40 which drives the wind-in shaft 40, and the sheet W transported by the rear driving roller 32 is wound onto the wind-in shaft 40. In this process, the printer control unit 200 controls the torque of the wind-in motor M40 and adjusts the tension (wind-in tension Tc) of the sheet W from the rear driving roller 32 to the wind-in shaft 40. To be specific, a tension sensor T41 which detects the wind-in tension Tc is attached to the driven roller 41 positioned between the rear driving roller 32 and wind-in shaft 40. This tension sensor T41 can be constituted by, for example, a load cell which detects the force received from the sheet W.

The printer control unit 200 carries out feedback control with respect to the torque of the wind-in motor M40 on the basis of a detection result of the tension sensor T41, and adjusts the wind-in tension Tc of the sheet W. To be specific, the printer control unit 200 reduces the wind-in tension Tc in accordance with an increase in the diameter of the roll including the sheet W that is wound onto the wind-in shaft 40. As a result, control is carried out in such a way that the sheet W is not damaged if the pressure on the sheet W near the roll center becomes excessive as the roll diameter increases. An image is thereby recorded on the sheet W.

Figure 6:
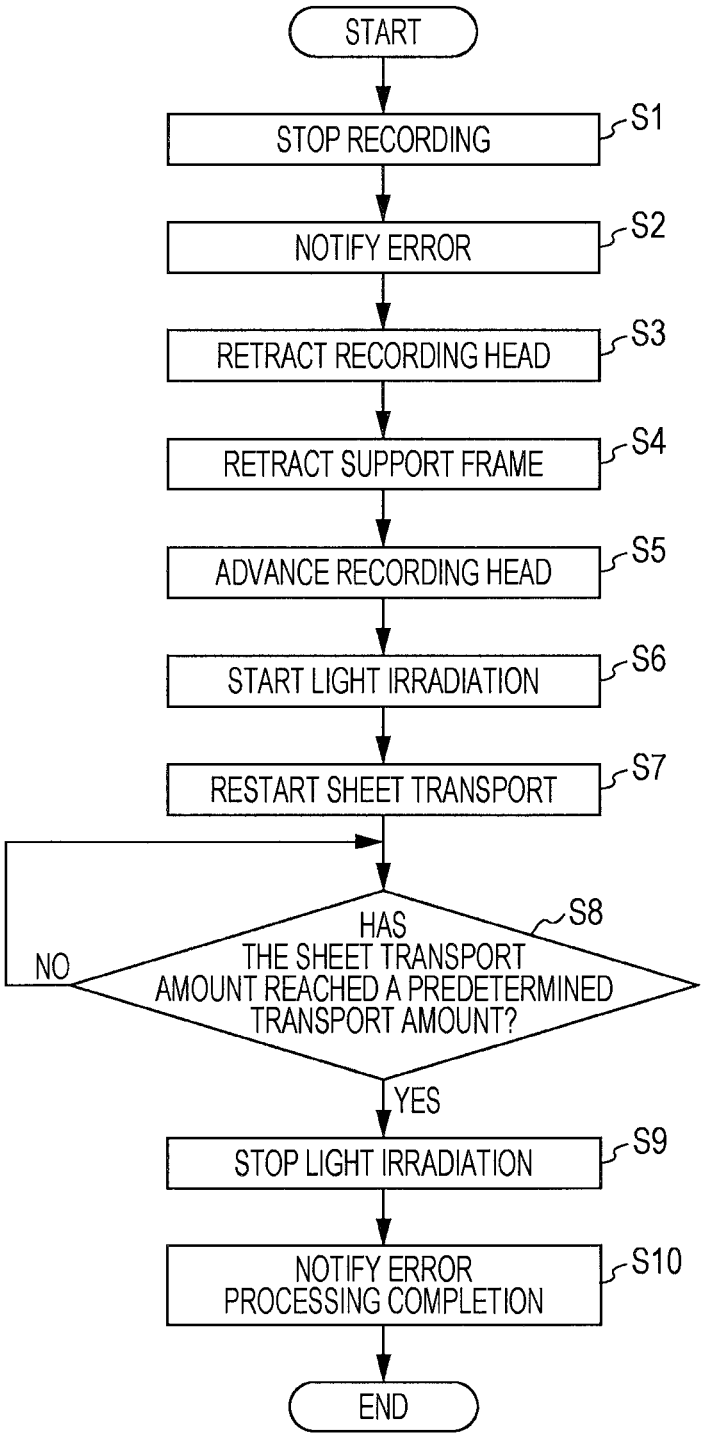
FIG. 6 is a flowchart illustrating the flow of the error processing in the embodiment.

Next, an example of error processing in the printer 1 will be described. In the printer 1, if the gap PG (see FIG. 2B) between the sheet W and recording heads 51 is outside (in excess of) the permitted range, the printer control unit 200 starts the error processing illustrated in FIG. 6. The following describes an example in which the gap PG (see FIG. 2B) has fallen below the lower limit value of the permitted range.

In the error processing, first, in Step S1, the printer control unit 200 stops the recording to the sheet W. Here, the printer control unit 200 stops the drive for the recording heads 51, the irradiation of light by the light irradiation device 63, and the transport of the sheet W.

Next, in Step S2, the printer control unit 200 notifies the error to the host control unit 100. The host control unit 100 receives the notification of the error from the printer control unit 200 and notifies the error to the operator by using the monitor 130.

Next, in Step S3, the printer control unit 200 drives the advancing/retracting motor M51 to retract the four recording heads 51 to the retracted position 74*b* (see FIG. 2B).

Next, in Step S4, the printer control unit 200 drives the advancing/retracting motor M81 to retract (move) the support frame 71 to the maintenance position 83*b* (see FIG. 4).

Next, in Step S5, the printer control unit 200 drives the advancing/retracting motor M51 to advance the four recording heads 51 to the advanced position 74*a* (see FIG. 2B). The four recording heads 51 are therefore covered by the caps 79.

Next, in Step S6, the printer control unit 200 drives the light irradiation device 63 to start (restart) the irradiation of light by the light irradiation device 63.

Next, in Step S7, the printer control unit 200 controls the drive for each of the feed-out motor M20, front drive motor M31, rear drive motor M32, and wind-in motor M40 and restarts the transport of the sheet W.

Next, in Step S8, the printer control unit 200 determines whether or not the transport amount of the sheet W has reached a predetermined transport amount L. At this time, if it is determined that the transport amount of the sheet W has reached the predetermined transport length L (Yes), processing moves to Step 9. On the other hand, if it is determined that the transport amount of the sheet W has not reached the predetermined transport length L (No), transport of the sheet W is continued until the transport amount of the sheet W reaches the predetermined transport length L.

During this process, in Step 8, the printer control unit 200 controls the amount of drive for the rear drive motor M32 to be equal to or less than the transport amount corresponding to the length of the transport path Pc from the gap sensor Wg to the light irradiation device 63, on the basis of a detection result obtained by the drum encoder E30. That is, after transport of the sheet W has been restarted, the printer control unit 200 stops the transport of the sheet W before the portion where the error in the sheet W has been detected (error portion) reaches the light irradiation device 63. Therefore, because the transport of the sheet W is stopped before the error portion reaches the light irradiation device 63, it is possible to avoid interference between the error portion and light irradiation device 63.

Next, in Step 9, the printer control unit 200 stops the irradiation of light by the light irradiation device 63.

Next, in Step S10, the printer control unit 200 notifies the completion of the error processing to the host control unit 100.

The error processing is completed as described above. In addition, the host control unit 100 receives the notification of the completion of the error processing from the printer control unit 200 and notifies the completion of the error processing to the operator by using the monitor 130.

It is therefore possible to prompt the operator to carry out error resolution processing. The error resolution processing is processing for eliminating the cause of the error and returning to a normal state (resolving the error).

Processing such as the following serves as an example of the error resolution processing. First, when the error processing has been completed, the host control unit 100 releases an interlock provided on an opening/closing cover of a casing which is not shown in the figures. It is therefore possible for the operator to open the opening/closing cover for access to the sheet W. It should be noted that if the printer 1 is carrying out recording, it is possible to maintain a state in which the opening/closing cover cannot be opened due to the operation of the interlock.

The operator removes the error portion in the sheet W and then takes the roll wound onto the wind-in shaft 40 out from the printer 1. Next, the operator winds the sheet W at the feed-out side onto the wind-in shaft 40 and starts a new wind-in operation. The error resolution processing is then completed by the operator closing the opening/closing cover.

In the embodiment, the recording heads 51 correspond to the discharge head, the sheet W corresponds to the drawing medium, the rear driving roller 32, nip roller 32*n* and rear drive motor M32 correspond to the transport device, the gap sensor Wg corresponds to the error detection device, and the light irradiation device 63 corresponds to the irradiation device. Furthermore, the advancing/retracting device 73 corresponds to the head movement device, the platen drum 30 corresponds to the support drum, the printer control unit 200 corresponds to the control unit, and the drum encoder E30 corresponds to the transport amount detection device.

In the embodiment, the transport of the sheet W is stopped if an error is detected on the basis of the gap sensor Wg which is provided further upstream than the recording heads 51. As a result, because the transport operation can be stopped before the error portion in the sheet W interferes with the recording heads 51, it is possible to avoid the sheet W from becoming stuck. Accordingly, the sheet W remaining on the transport path Pc from the recording heads 51 to the light irradiation device 63 is maintained in a normal state at the point in time when the error is detected. The recording heads 51 are retracted, and then transport of the sheet W is restarted in a state in which light is applied by the light irradiation device 63. During this process, the sheet W remaining on the transport path Pc from the recording heads 51 to the light irradiation device 63 is maintained in a normal state, and it is therefore possible to restart the transport of the sheet W in a state in which the position of the light irradiation device 63 is maintained. It is therefore possible to irradiate the ink remaining on the transport path Pc from the recording heads 51 to the light irradiation device 63 with light. As a result, it is possible to irradiate the ink that was coated on the sheet W before the error was detected with light, and it is therefore possible to eject the sheet W to outside the printer 1 after the coated ink has been cured. Furthermore, in this error processing method, it is possible to apply light while the position of the light irradiation device 63 is maintained even when an error has been detected, and the irradiation energy required to cure the ink may be ensured without changing the light intensity or irradiation time. As a result, it is possible to easily avoid the sequence in the error processing from becoming complicated, and it is therefore possible to easily attain efficiency in the drawing process.

Furthermore, in the embodiment, the recording heads 51 are covered by the caps 79 and then the transport of the sheet W and the irradiation of light by the light irradiation device 63 are restarted, and it is therefore possible to apply light by the light irradiation device 63 in a state in which the discharge outlets of the recording heads 51 are shielded from light by the caps 79. It is consequently possible to make it difficult for the ink within the discharge openings of the recording heads 51 to cure. As a result, because it is possible to easily limit a decline in the ink discharge performance of the recording heads 51, it is possible to satisfactorily maintain recording quality.

Furthermore, in the embodiment, the sheet W is supported by the platen drum 30 which has the sheet W wound therearound and rotates by receiving the frictional force with the transported sheet W. In this configuration, the platen drum 30 supporting the sheet W follows the transported sheet W and rotates. This is therefore advantageous for suppressing slippage between the sheet W and platen drum 30 and stabilizing the tension of the sheet W.

It should be noted that the embodiment employs a configuration in which the sheet W is supported by the platen drum 30 which is cylindrical. However, the configuration for supporting the sheet W is not limited to the platen drum 30. A configuration which supports the sheet W in a flat manner by a flat platen may also be employed as a configuration for supporting the sheet W.

Furthermore, in the embodiment, yellow, cyan, magenta, and black ink are employed as four types of ink. However, the types are not limited to the aforementioned types. Other than these, types of ink such as light cyan, light magenta, white, clear, and metallic ink may be employed as the types of inks.

What is claimed is:

1. A drawing device, comprising:

a discharge head that discharges a liquid which cures when receiving irradiation light;

a transport device that transports a drawing medium coated with the liquid discharged from the discharge head, along a transport path that faces the discharge head;

an error detection device that is provided further upstream along the transport path than the discharge head, and detects an error with respect to a gap between the drawing medium and the discharge head;

an irradiation device that is provided further downstream along the transport path than the discharge head, and irradiates the liquid coated on the drawing medium with light;

a head movement device that retracts the discharge head to a position away from the transport path; and a control unit that individually controls drive for each of the transport device, the irradiation device, and the head movement device, the control unit being configured such that when the error is detected, the control unit stops the drive for the transport device, drives the head movement device to retract the discharge head, and then restarts the drive for the transport device in a state in which the irradiation device is driven to apply the light.

2. The drawing device according to claim 1, further comprising a support drum that is provided facing the discharge head with the transport path positioned therebetween, and rotates in accordance with the transport of the drawing medium while supporting the drawing medium.

3. The drawing device according to claim 1, further comprising a transport amount detection device that detects a transport amount of the drawing medium, wherein when the drive for the transport device is restarted, the control unit controls the amount of drive for the transport device to be equal to or less than the transport amount corresponding to a length of the transport path from the error detection device to the irradiation device, on the basis of a detection result obtained by the transport amount detection device.

4. The drawing device according to claim 1, further comprising a cap that covers a discharge opening for the liquid in the discharge head.

5. The drawing device according to claim 1, wherein the head movement device retracts the discharge head along a direction normal to a surface of the drawing medium facing the discharge head.

6. An error processing method comprising:

discharging a liquid which cures when receiving irradiation light from a discharge head onto the drawing medium which is transported along a transport path that faces the discharge head;

irradiating the liquid coated on the drawing medium with light by an irradiation device provided further downstream along the transport path than the discharge head to perform drawing;

stopping the transport of the drawing medium if an error with respect to a gap between the drawing medium and discharge head is detected by an error detection device provided upstream of the discharge head;

retracting the discharge head to a position away from the transport path; and restarting the transport of the drawing medium in a state in which the light is applied by the irradiation device.

7. The error processing method according to claim 6, further comprising stopping transport of the drawing medium after the transport of the drawing medium has been restarted, before the portion in the drawing medium where the error has been detected reaches the irradiation device.

8. The error processing method according to claim 6, wherein the retracting of the discharge head includes retracting the discharge head along a direction normal to a surface of the drawing medium facing the discharge head.

* * * * *